US010182490B2

(12) United States Patent
Miller et al.

(10) Patent No.: US 10,182,490 B2
(45) Date of Patent: Jan. 15, 2019

(54) X-RAY TUBE INTEGRAL HEATSINK

(71) Applicant: Moxtek, Inc., Orem, UT (US)

(72) Inventors: Eric Miller, Provo, UT (US); Thomas E. Blair, Lehi, UT (US)

(73) Assignee: Moxtek, Inc., Orem, UT (US)

( * ) Notice: Subject to any disclaimer, the term of this patent is extended or adjusted under 35 U.S.C. 154(b) by 356 days.

(21) Appl. No.: 15/228,938

(22) Filed: Aug. 4, 2016

(65) Prior Publication Data

US 2017/0094761 A1 Mar. 30, 2017

Related U.S. Application Data

(60) Provisional application No. 62/232,622, filed on Sep. 25, 2015.

(51) Int. Cl.

| | |
|---|---|
| ***H01J 35/06*** | (2006.01) |
| ***H05G 1/02*** | (2006.01) |
| ***H01J 35/08*** | (2006.01) |

(52) U.S. Cl.

CPC ..... *H05G 1/025* (2013.01); *H01J 35/06* (2013.01); *H01J 35/08* (2013.01); *H01J 2235/1291* (2013.01)

(58) Field of Classification Search

CPC .. H01L 35/06; H01L 35/08; H01J 2235/1291; H05G 1/025

USPC ..... 378/142

See application file for complete search history.

(56) References Cited

U.S. PATENT DOCUMENTS

| | | | | |
|---|---|---|---|---|
| 5,814,824 | A * | 9/1998 | Hamby | G21D 1/02 250/506.1 |
| 7,175,803 | B2 * | 2/2007 | Artig | H01J 35/16 378/203 |
| 8,233,589 | B2 * | 7/2012 | Hauttmann | H01J 35/16 378/136 |
| 2010/0071883 | A1 | 3/2010 | Vetrovec | |
| 2015/0098552 | A1 | 4/2015 | Draper et al. | |
| 2017/0338076 | A1 * | 11/2017 | Hess | H01J 35/12 |

FOREIGN PATENT DOCUMENTS

| | | | |
|---|---|---|---|
| EP | 1475819 | | 3/2013 |
| JP | 2003-123999 | A | 4/2003 |
| JP | 2007-005283 | A | 1/2007 |
| KR | 10-2006-009146 | A | 1/2006 |

* cited by examiner

*Primary Examiner* — Kenneth J Malkowski
(74) *Attorney, Agent, or Firm* — Thorpe, North & Western, LLP

(57) ABSTRACT

Improved heat transfer from an x-ray tube can be accomplished with a heatsink surrounding at least part of an x-ray tube. The heatsink can be electrically connected to an anode of the x-ray tube and can be an electrical current path. The heatsink can include a plurality of protrusions extending radially outward from the x-ray tube and can be a single, integral substance extending from an inner-surface of the heatsink to a distal-end of the protrusions.

20 Claims, 3 Drawing Sheets

X-RAY TUBE INTEGRAL HEATSINK

CLAIM OF PRIORITY

This claims priority to U.S. Provisional Patent Application No. 62/232,622, filed on Sep. 25, 2015, which is hereby incorporated herein by reference in its entirety.

FIELD OF THE INVENTION

The present application is related generally to heat removal from x-ray sources.

BACKGROUND

X-ray sources can include an x-ray tube and a power supply. Electrical current flow through the x-ray tube can produce a substantial amount of heat, which can damage the x-ray source if not removed. Removal of this heat is especially important for continuously-operated x-ray sources.

Water heat exchangers can remove this heat, but may be undesirable due to cost and size. Improved heat transfer from an x-ray tube, without a water heat exchanger, would be desirable. Fans can remove this heat, but may be undesirable due to particulate contamination if used in a clean room or due to cost. Thus, an optimal design of an x-ray source may be cooling without a water heat exchanger or a fan.

In some x-ray sources, the x-ray tube is rigidly mounted onto the power supply. In other x-ray sources, sometimes due to lack of space, the x-ray tube is movable separate from the power supply and is connected to the power supply by an extended, flexible cable. Heat removal from the rigidly-mounted designs can be easier than in the cabled designs because a metal housing for the x-ray tube and power supply can be used as a heatsink for the x-ray tube. Thus, improved heat transfer from a cabled x-ray tube can be particularly important.

SUMMARY

It has been recognized that it would be advantageous to provide improved heat transfer from an x-ray tube. The present invention is directed to various embodiments of x-ray sources to satisfy this need.

The x-ray source can comprise an x-ray tube and a heatsink. The x-ray tube can include a cathode and an anode. The heatsink can be electrically conductive, electrically-coupled to the anode, and electrically-insulated from the cathode. The heatsink can include a plurality of protrusions extending radially outward from the x-ray tube, for increasing heat transfer away from the x-ray tube.

In one embodiment, the x-ray source can further comprise a power supply. The power supply can be electrically-coupled to the heatsink and can be configured to cause electrons to flow from the cathode to the anode, then from the anode through the heatsink to a ground or to the power supply.

In another embodiment, the protrusions of the heatsink can be a single, integral substance extending from an inner-surface of the heatsink to a distal-end of the protrusions.

In one embodiment, the x-ray source can further comprise an enclosure, which can be electrically-insulative, and an electrically-insulative material. The cathode and the anode can be attached to the enclosure. The electrically-insulative material can encircle the enclosure and can adjoin an outer-surface of the enclosure and an inner-surface of the heatsink.

DEFINITIONS

Figure 1:
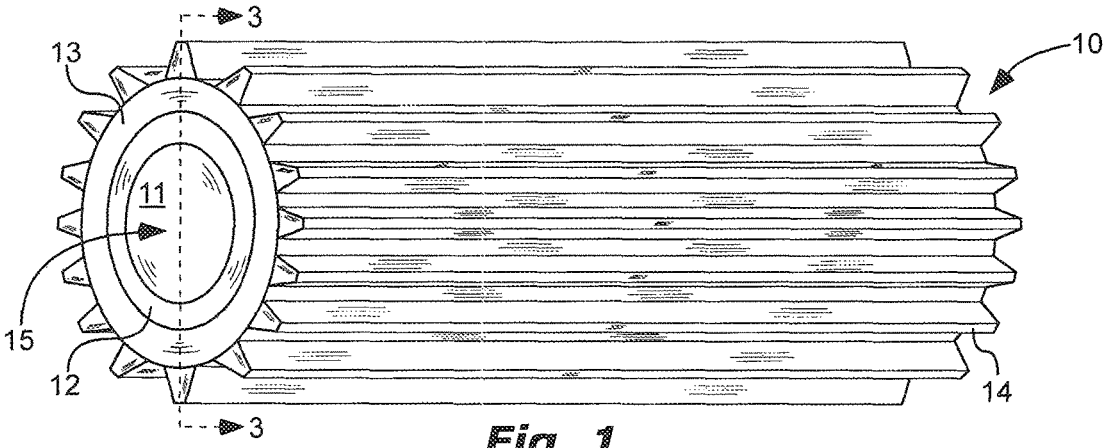
FIG. 1 is a schematic perspective view of an x-ray source 10 including an x-ray tube 15 and a heatsink 13, in accordance with an embodiment of the present invention.
Figure 2:
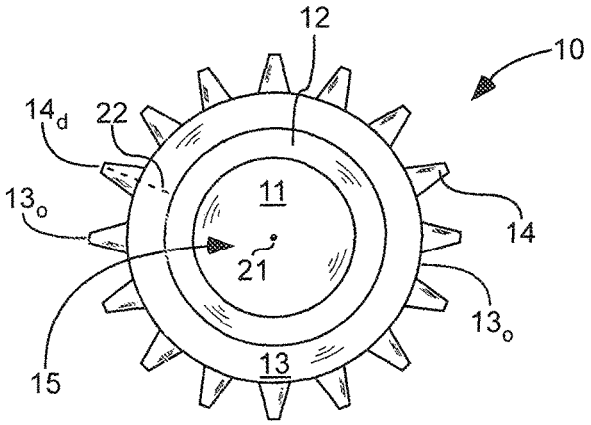
FIG. 2 is a schematic end view of the x-ray source 10 of FIG. 1, in accordance with an embodiment of the present invention.
Figure 3:
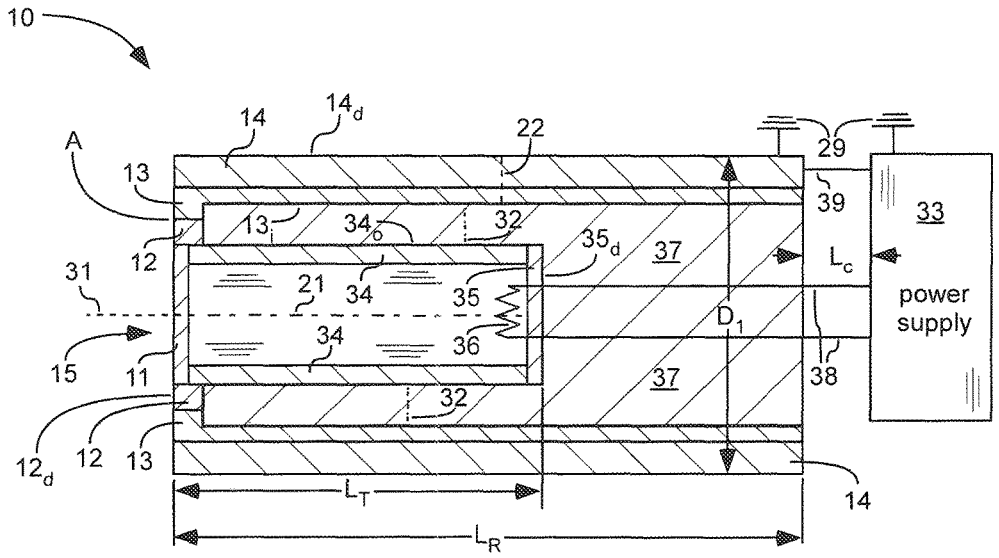
FIG. 3 is one schematic cross-sectional side view of the x-ray source 10 of FIG. 1 taken along line 3-3 in FIG. 1, the x-ray source 10 further comprising a power supply 33 electrically-coupled to the heatsink 13 and configured to cause electrons to flow from a cathode 35 to an anode 12 of the x-ray tube 15, then from the anode 12 through the heatsink 13 to a ground 29 or to the power supply 33, in accordance with an embodiment of the present invention.

As used herein, the terms "adjoin" and "adjoins" mean that the two materials border each other, are in physical contact with each other, touch each other, and abut each other, surface to surface.

As used herein, the term "electrostatic discharge" means a rapid or sudden discharge of static, electrical charge, often resulting in damage.

As used herein, the term "electrostatic dissipation" means a relatively slow discharge of static, electrical charges, normally without damage.

DETAILED DESCRIPTION

As illustrated in FIGS. 1-4, x-ray source 10 is shown comprising an x-ray tube 15, a heatsink 13, an electrically-insulative material 37, and a power supply 33.

The x-ray tube 15 can include a cathode 35, an anode 12, and an enclosure 34. The cathode 35 and the anode 12 can be electrically insulated from each other. The enclosure 34 can be electrically-insulative. The cathode 35 and the anode 12 can be attached to the enclosure 34. The cathode 35 can be located at one end of a longitudinal axis 21 extending through a hollow core of the enclosure 34, and the anode 12 can be located at an opposite end of the longitudinal axis 21. A distal-end $\mathbf{35}_d$ of the cathode 35 can be an end of the cathode 35 farthest from the anode 12 and a distal-end $\mathbf{12}_d$ of the anode 12 can be an end of the anode 12 farthest from the cathode 35.

The cathode 35 can include an electron-emitter 36 (e.g. filament) capable of emitting electrons towards the anode 12. The electrons can travel along the longitudinal axis 21 from the cathode 35 to the anode 12. The anode 12 can emit x-rays 31 through an x-ray window 11 in response to impinging electrons from the electron-emitter 36. Not that although a transmission target x-ray tube 15 is shown in FIGS. 1-4, side window x-ray tubes are also within the scope of this invention.

The x-ray source 10 can include various features for increasing heat transfer away from the x-ray tube 15 and can allow continuous operation of some x-ray sources without a liquid heat exchanger. Some x-ray sources with the designs specified herein can be cooled by ambient air, even without forced-convection cooling. For example, the invention was used on a 5 watt, 10 kilovolt, cabled x-ray source with continuous operation without a liquid heat exchanger or forced-convection cooling. The following designs can improve heat transfer away from the x-ray tube 15 and can allow the x-ray tube 15 to be located in small locations.

In one aspect, the heatsink 13 can encircle at least a portion or all of the cathode 35, the anode 12, the enclosure 34, or combinations thereof. The heatsink 13 can completely encircle the x-ray tube 15 along the longitudinal axis 21. The heatsink 13 can completely encircle the anode 12 from one end to an opposite end, the cathode 35 from one end to an opposite end, the enclosure 34 from one end to an opposite end, or combinations thereof, along the longitudinal axis 21. In some designs, it can be beneficial for the heatsink 13 to extend beyond the distal-end $\mathbf{35}_d$ of the cathode 35, such as for example to provide structural support for this region or to improve heat transfer. The heatsink 13 can extend beyond the distal-end $\mathbf{35}_d$ of the cathode 35 for a distance of at least 25% of the length of the x-ray tube 15 ($0.25*L_T$) in one aspect, for a distance of at least 50% of the length of the x-ray tube 15 ($0.5*L_T$) in another aspect, or for a distance of 75% of the length of the x-ray tube 15 ($075*L_T$) in another aspect. For example, in FIG. 3 the heatsink 13 extends beyond the distal-end $\mathbf{35}_d$ of the cathode 35 for a distance of about 70% of the length of the x-ray tube 15 ($0.7*L_T$). The heatsink 13 can have various shapes, including a cylinder-shape.

The heatsink 13 can include a plurality of protrusions 14 extending radially outward from the x-ray tube 15. The protrusions 14 can be configured (e.g. by shape, size, and material) to increase heat transfer away from the x-ray tube 15. The protrusions 14 can be various shapes, including posts or elongated ribs. The ribs can include at least 10 ribs in one aspect or at least 16 ribs in another aspect. At least some of the ribs can have a length $L_R$ that is at least as long as a length $L_T$ of the x-ray tube 15, i.e. from the distal-end $\mathbf{35}_d$ of the cathode 35 to the distal-end $\mathbf{12}_d$ of the anode 12. A length $L_R$ of the ribs can extend substantially-parallel to a direction of electron flow (substantially along the longitudinal axis 21) from the cathode 35 to the anode 12.

Examples of heat flux from the anode 12 to the heatsink 14, and from the heatsink 14 to the air, even without any form of forced convection, can be relatively high, such as for example greater than 20,000 $W/m^2$ in one aspect, greater than 40,000 $W/m^2$ in another aspect, greater than 80,000 $W/m^2$ in another aspect, or greater than 100,000 $W/m^2$ in another aspect.

The x-ray source 10 can be useful for electrostatic dissipation. X-rays can ionize air which can gradually reduce static charges on devices (e.g. electronic circuits, instruments, or tools). This gradual reduction of electrical charges can help avoid rapid electrostatic-discharge, which can damage or destroy some devices. Some locations where electrostatic dissipation is needed have tight clearances, and thus a small x-ray source may be required. Elongated ribs aligned parallel to the longitudinal axis 21 can be beneficial not just for improved heat transfer, and allowing the x-ray tube 15 to be located in small locations, but also can aid in channeling ions from the x-ray tube 15 to the device needing electrostatic dissipation. Forced air-flow substantially-parallel to the longitudinal axis 21 and the ribs can be especially helpful for aiding ion transfer to the device.

The x-ray source 10 can include an electrically-insulative material 37 located in an annular gap between the heatsink 13 and the enclosure 34 and/or the cathode 35. The electrically-insulative material 37 can encircle part or all of the enclosure 34 and/or the cathode 35. The electrically-insulative material 37 can fill an annular portion of, or can completely fill, the annular gap. The electrically-insulative material 37 can at least partially separate the heatsink 13 from the enclosure 34 and/or the cathode 35. The electrically-insulative material 37 can adjoin an outer-surface $\mathbf{34}_o$ of the enclosure 34 and can adjoin an inner-surface $\mathbf{13}_i$ of the heatsink 13. The electrically-insulative material 37 can provide electrical insulation between the heatsink 13 and the enclosure 34 and/or the cathode 35.

Figure 4:
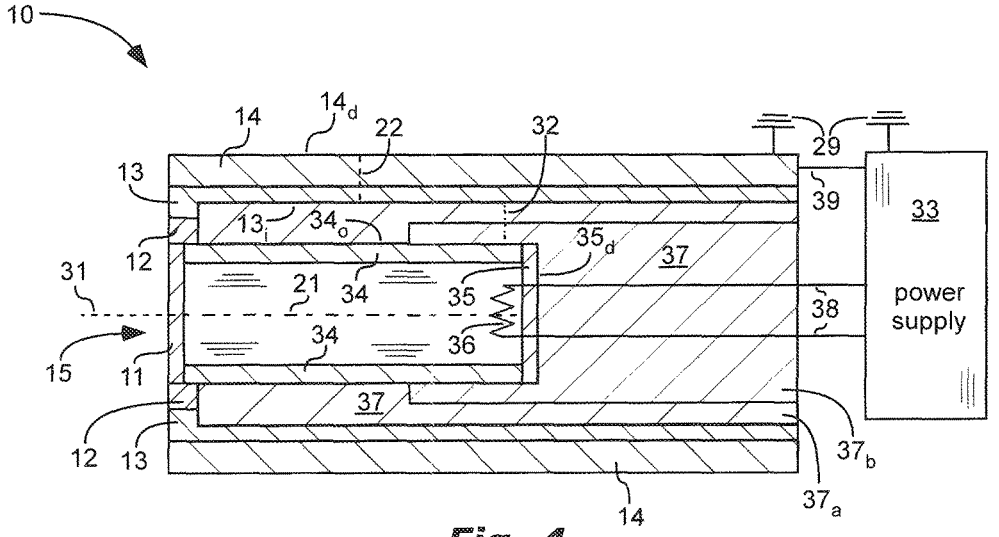
FIG. 4 is another schematic cross-sectional side view of the x-ray source 10 of FIG. 1 taken along line 3-3 in FIG. 1, similar to that shown in FIG. 3, except that an electrically-insulative material 37 for electrical insulation is divided into layers $\mathbf{37}_a$ and $\mathbf{37}_b$, each layer made of a different substance, in accordance with an embodiment of the present invention.

The electrically-insulative material 37 can be a single layer of one electrically-insulative substance (see FIG. 3) or multiple layers of different electrically-insulative substances (see FIG. 4). The electrically-insulative material 37 can include only electrically-insulative substances.

A simple method of making x-ray source 10 is shown in FIG. 4. The electrically-insulative material 37 can include two layers $\mathbf{37}_a$ and $\mathbf{37}_b$. One layer $\mathbf{37}_a$ of the electrically-insulative material 37 can be a solid cylinder and can be easily inserted around the x-ray tube 15. The solid cylinder can be polyether ether ketone (PEEK), and can extend beyond a distal-end $\mathbf{35}_d$ of the cathode 35, and thus also around part of wires 38 connecting the electron-emitter 36 to the power supply 33. A liquid, electrically-insulative potting or epoxy (e.g. EP1285 by ResinLab) can be poured or pressed inside the PEEK cylinder, around the wires 38, and possibly also around part of the cathode 35. The potting or epoxy can then harden into a second layer $\mathbf{37}_b$ of the electrically-insulative material 37. Thus, the electrically-insulative material 37 can include at least two layers $\mathbf{37}_a$ and $\mathbf{37}_b$ of different substances. As shown in FIG. 4, a radial path 32 from the outer-surface $\mathbf{34}_o$ of the enclosure 34 to the inner-surface $\mathbf{13}_i$ of the heatsink 13 can pass through these two layers $\mathbf{37}_a$ and $\mathbf{37}_b$.

Heat transfer can be improved if the electrically-insulative material 37, or at least a region or layer $\mathbf{37}_a$ or $\mathbf{37}_b$ of the electrically-insulative material 37, has a relatively high thermal conductivity, such as at least 0.7 W/(m*K) in one aspect, at least 0.8 W/(m*K) in another aspect, at least 1.0 W/(m*K) in another aspect, or at least 1.2 W/(m*K) in another aspect.

X-ray source size can be reduced, and the x-ray source 10 can be more robust, if the electrically-insulative material 37 has a high electrical resistivity. For example, the electrically-insulative material 37 or a region or layer $\mathbf{37}_a$ or $\mathbf{37}_b$ of the electrically-insulative material 37 can have a volume electrical resistivity of greater than $10^8$ ohm-cm in one aspect, greater than $10^{12}$ ohm-cm in another aspect, greater than $10^{14}$ ohm-cm in another aspect, or greater than $10^{16}$ ohm-cm in another aspect.

Some materials have high thermal conductivities but low electrical resistivity, and other materials have low thermal conductivities but high electrical resistivity. Use of layers $\mathbf{37}_a$ and $\mathbf{37}_b$ can improve both the electrical resistance and the thermal conductivity of the electrically-insulative material 37 as a whole. Approximate thermal conductivity and electrical resistivity values of potential substances for the electrically-insulative material 37 are shown in the following table:

| | Thermal Conductivity W/(m*K) | Volume Resistivity Ohm*cm |
|---|---|---|
| PEEK | 0.3 | $5 \times 10^{16}$ |
| Epoxy | 0.8 to 1.3 | $1 \times 10^{15}$ |

Figure 5:
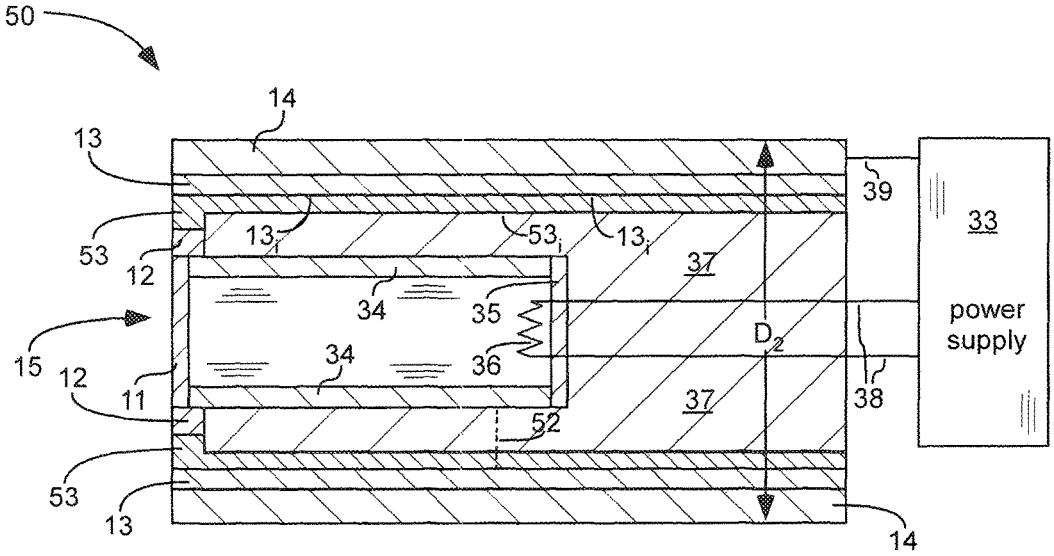
FIG. 5 is a schematic cross-sectional side view of an x-ray source 50 including an x-ray tube 15, a heatsink 13, a housing 53, and a power supply 33.

X-ray source 50 in FIG. 5 is similar to x-ray source 10, but with a difference that x-ray source 50 has a housing 53, holding the x-ray tube 15. The heatsink 13 can be attached to an outer surface of the housing 53. X-ray source 50 can have heat transfer disadvantages in comparison with x-ray source 10.

On x-ray source 50, the housing 53 is in the line of heat transfer. Heat transfer resistance at a junction between the housing 53 and the anode 12, through the housing 53, and at a junction between the housing 53 and the heatsink 13, can reduce heat transfer away from the anode 12. On x-ray source 50, the electrically-insulative material 37 adjoins an inner surface $\mathbf{53}_i$ of the housing 53 but not an inner surface $\mathbf{13}_i$ of the heatsink 13.

The heatsink 13 of x-ray source 10 can be a single, integral substance extending from an inner-surface $\mathbf{13}_i$ of the heatsink 13 to a distal-end $\mathbf{14}_d$ of the protrusions 14 (along path 22). The electrically-insulative material 37 can encircle and can adjoin an outer-surface $\mathbf{34}_o$ of the enclosure 34 and can adjoin an inner surface $\mathbf{13}_i$ of the heatsink 13. Thus, radial path 32 from the outer-surface $\mathbf{34}_o$ of the enclosure 34 to the inner-surface $\mathbf{13}_i$ of the heatsink 13 passes only through the electrically-insulative material 37. As a result there can be a shorter, heat-transfer, radial path 32 in comparison to heat transfer path 52 in x-ray source 50.

An additional advantage of x-ray source 10 in comparison to x-ray source 50 is a possibly smaller maximum outside diameter ($D_1<D_2$) of the heatsink 13. Improved heat transfer from x-ray source 10, described in the preceding paragraphs, can allow use of a smaller heatsink 13.

The housing 53 of x-ray source 50 can result in an increased maximum diameter $D_2$ of its heatsink 13 in comparison to a maximum outside diameter $D_1$ of the heatsink 13 in x-ray source 10. A minimally thick housing 53 plus a minimally thick heatsink 13 can be needed for sufficient structural strength of each device. X-ray source 10 lacks the housing 53 and thus can have its heatsink 13 maximum outside diameter $D_1$ reduced.

The maximum outside diameter $D_1$ of the heatsink 13 can be less than 20 millimeters in one aspect, less than 25 millimeters in another aspect, less than 30 millimeters in another aspect, less than 40 millimeters in another aspect, or less than 50 millimeters in another aspect. The term "maximum" outside diameter means that if the heatsink 13 has multiple outside diameters, then the largest of these is selected. Having a smaller maximum outside diameter $D_1$ can allow placement of the x-ray tube 15 and heatsink 14 in smaller locations.

The heatsink 13 can be electrically conductive and can be used as an electrical current path to ground 29 or to the power supply 33. The heatsink 13 and/or the protrusions 14 can be made of materials that are electrically conductive, have high heat transfer, and have sufficient structural strength. Using the heatsink 13 for heat removal, as an electrical current path, and as a casing for the x-ray tube 15, can eliminate the need for additional device(s) to serve such purposes, thus allowing for a possibly less expensive and more compact x-ray source 10.

The phrase that the heatsink 13 is electrically conductive means that the heatsink 13 can be a path for conduction of electricity due to a high electrical conductivity of a substantial portion of the heatsink 13, but part of the heatsink 13 can be electrically-resistive. For example, an outer surface $\mathbf{13}_o$ (see FIG. 2) of the heatsink 13 can be electrically-resistive. It can be beneficial in some designs if most or substantially all electrons flowing through the heatsink 13 go to the power supply 33 instead of to ground 29. Electron flow to the power supply 33 instead of to ground 29 can be important if x-ray tube 15 electrical current is measured by these electrons flowing back to the power supply 33 or if electron flow to ground 29, through surrounding equipment, could cause malfunction of such equipment.

Thus, for example a core of, or an electrical path through, the heatsink 13 can have an electrical resistivity of less than $10^{-2}$ ohm*cm in one aspect, less than $10^{-4}$ ohm*cm in another aspect, or less than $10^{-6}$ ohm*cm in another aspect. Some or substantially all of an outer surface of the heatsink 13 can have an electrical resistivity of greater than $10^8$ ohm-cm in one aspect, greater than $10^9$ ohm-cm in another aspect, greater than $10^{10}$ ohm-cm in another aspect, or greater than $10^{11}$ ohm-cm in another aspect.

The heatsink 13 can be made of aluminum. The anode 12 and the power supply 33 can electrically connect to the heatsink 13 at ends or at an inner surface of the heatsink 13. An outer surface $\mathbf{13}_o$ of the heatsink 13 can be anodized to form an electrically resistive outer surface $\mathbf{13}_o$.

The heatsink 13 can be the sole path for electrons to flow from the anode 12 to ground 29 or to the power supply 33, and thus the need for a separate electrical conduit can be avoided. The "sole" electrical current path means the sole path for any substantial amount of electrical current and the sole desired path for electrical current (ignoring negligible leakage current, such as micro amps or nano amps). The heatsink 13 can be the primary path, such that at least 90% in one aspect, at least 95% of in another aspect, at least 99% in another aspect, or at least 99.9% in another aspect, of electrons flowing from the anode 12 to the power supply 33, flow through the heatsink 13.

The heatsink 13 can be electrically-coupled to the anode 12 and can be electrically-insulated from the cathode 35. It can be important to have low electrical resistance between the anode 12 and the heatsink 13, in order to minimize heat generation caused by electrical current between the anode 12 and the heatsink 13. The heatsink 13 can be directly electrically-coupled to the anode 12 by an electrically-conductive solder, weld, epoxy, adhesive, press-fit, or combinations thereof (e.g. silver epoxy or silver solder). A resistance between the anode 12 and the heatsink 13 can be less than 0.1 ohms in one aspect, less than 0.01 ohms in another aspect, less than 0.001 ohms in another aspect, less than 0.0001 ohms in another aspect, or less than 0.00001 ohms in another aspect.

The power supply 33 can be configured to provide a voltage between the electron-emitter 36 and the anode 12 (via electrical connectors 38 and electrical connector 39 or ground 29) to at least assist in causing the electrons to emit from the cathode 35 to the anode 12. Electron-emitter 36 heat, the voltage differential, and the overall x-ray tube design can cause the electrons to emit from the cathode 35 to the anode 12.

In some x-ray sources, the x-ray tube 15 is firmly or inflexibly mounted onto the power supply 33. In some applications, due to lack of space, there may be a need to for the x-ray tube 15 to be distant from the power supply 33. To allow for this separation, the power supply 33 can be electrically-coupled to the heatsink 13 and the x-ray tube 15 by a cable. The cable can have various lengths, such as for example a length of at least one meter in one aspect, at least two meters in another aspect, at least four meters in another aspect, or at least six meters in another aspect. Heat removal from the x-ray tube 15 can be easier in the x-ray sources that have the x-ray tube 15 inflexibly mounted onto the power supply 33 than the cabled designs, because a housing for both the x-ray tube 15 and power supply 33 can improve heat transfer from the x-ray tube. Thus, the invention described herein can be especially beneficial in the cabled designs for improving heat transfer.

What is claimed is:

1. An x-ray source comprising:

a. an x-ray tube including a cathode, an anode, and an enclosure, wherein:

i. the enclosure is electrically-insulative;

ii. the cathode and the anode are electrically insulated from each other;

iii. the cathode and the anode are attached to the enclosure;

iv. the cathode includes an electron-emitter capable of emitting electrons towards the anode; and v. the anode is capable of emitting x-rays in response to impinging electrons from the electron-emitter;

b. a heatsink, wherein the heatsink:

i. is electrically conductive;

ii. is electrically-coupled to the anode and electrically-insulated from the cathode; and iii. includes a plurality of protrusions extending radially outward from the x-ray tube, the protrusions configured to increase heat transfer away from the x-ray tube; and c. electrically-insulative material encircling and adjoining an outer-surface of the enclosure and adjoining an inner-surface of the heatsink.

2. The x-ray source of claim 1, wherein a radial path from the outer-surface of the enclosure to the inner-surface of the heatsink passes only through the electrically-insulative material.

3. The x-ray source of claim 2, wherein the electrically-insulative material includes at least two layers of different substances.

4. The x-ray source of claim 1, wherein the electrically-insulative material includes a region with a thermal conductivity of at least 0.8 W/(m*K).

5. The x-ray source of claim 1, further comprising a power supply, wherein:

a. the power supply is configured to provide a voltage between the electron-emitter and the anode to at least assist in causing the electrons to emit from the cathode to the anode;

b. the power supply is electrically-coupled to the heatsink; and c. the x-ray source is configured for at least 90% of electrons flowing from the anode to a ground or to the power supply to pass through the heatsink.

6. The x-ray source of claim 1, wherein a resistance between the anode and the heatsink is less than 0.01 ohms.

7. The x-ray source of claim 1, wherein a maximum outside diameter of the heatsink is less than 40 millimeters.

8. The x-ray source of claim 1, wherein the heatsink is a single, integral substance extending from an inner-surface of the heatsink to a distal-end of the protrusions.

9. The x-ray source of claim 1, wherein/further comprising . . .

the cathode is located at one end of a longitudinal axis extending through a hollow core of the enclosure and the anode is located at an opposite end of the longitudinal axis; and the heatsink encircles the longitudinal axis and the x-ray tube about the longitudinal axis.

10. The x-ray source of claim 1, wherein the electrically-insulative material includes a region with an electrical volume resistivity of at least $1\times10^{16}$ ohm*cm.

11. The x-ray source of claim 1, wherein:

the plurality of protrusions include a plurality of elongated ribs;

a length of the plurality of elongated ribs extends substantially-parallel to a direction of electron flow from the cathode to the anode; and the plurality of elongated ribs include at least 10 ribs having a length at least as long as a length of the x-ray tube.

12. The x-ray source of claim 1, wherein at least a portion of an outer surface of the heatsink has an electrical volume resistivity of at least $10^8$ ohm*cm.

13. The x-ray source of claim 1, wherein the electrically-insulative material completely fills an annular portion of an annular gap between the heatsink and the enclosure.

14. The x-ray source of claim 1, wherein the heatsink is directly electrically-coupled to the anode by an electrically-conductive solder.

15. The x-ray source of claim 1, wherein the heatsink is directly electrically-coupled to the anode by a weld.

16. The x-ray source of claim 1, wherein the heatsink is directly electrically-coupled to the anode by epoxy, adhesive, or both.

17. The x-ray source of claim 1, wherein the heatsink is directly electrically-coupled to the anode by press-fit.

18. The x-ray source of claim 1, wherein the electrically-insulative material has thermal conductivity of at least 1.2 W/(m*K).

19. The x-ray source of claim 5, wherein the power supply is electrically coupled to the heatsink and the x-ray tube by a cable, the cable having a length of at least two meters.

20. The x-ray source of claim 5, wherein the x-ray source is configured for at least 99% of electrons flowing from the anode to a ground or to the power supply to pass through the heatsink.

* * * * *